United States Patent [19]

Niggemann et al.

[11] Patent Number: 4,880,055

[45] Date of Patent: Nov. 14, 1989

[54] IMPINGEMENT PLATE TYPE HEAT EXCHANGER

[75] Inventors: Richard E. Niggemann; Dam C. Nguyen, both of Rockford, Ill.

[73] Assignee: Sundstrand Corporation, Rockford, Ill.

[21] Appl. No.: 280,956

[22] Filed: Dec. 7, 1988

[51] Int. Cl.[4] ..... F28F 3/00

[52] U.S. Cl. ..... 165/167; 165/908

[58] Field of Search ..... 165/167, 908

[56] References Cited

U.S. PATENT DOCUMENTS

| | | | |
|---|---|---|---|
| 3,491,184 | 1/1970 | Rietdijk | 264/254 |
| 3,534,813 | 10/1970 | Fleming | 165/164 |
| 3,804,159 | 4/1974 | Searight et al. | 165/109 |
| 4,108,242 | 8/1978 | Searight et al. | 165/164 |
| 4,149,591 | 4/1979 | Alberteen | 165/165 |
| 4,188,996 | 2/1980 | Pellant et al. | 165/80 C |
| 4,201,195 | 5/1980 | Sakhuja | 126/449 |
| 4,258,383 | 3/1981 | Kessler, Jr. | 357/82 |
| 4,291,754 | 9/1981 | Morse et al. | 165/165 |
| 4,291,760 | 9/1981 | Argvie et al. | 165/166 |
| 4,296,455 | 10/1981 | Leaycraft et al. | 361/383 |
| 4,347,896 | 9/1982 | Rosman et al. | 165/166 |
| 4,347,897 | 9/1982 | Sumitomo et al. | 165/167 |
| 4,368,779 | 1/1983 | Rojey et al. | 165/165 |
| 4,399,484 | 8/1983 | Mayer | 361/382 |
| 4,445,569 | 5/1984 | Sabo et al. | 165/165 |
| 4,494,171 | 1/1985 | Bland et al. | 361/386 |
| 4,516,632 | 5/1985 | Swift | 165/167 |
| 4,624,305 | 11/1986 | Rojey | 165/165 |

*Primary Examiner*—Robert G. Nilson

*Attorney, Agent, or Firm*—Wood, Dalton, Phillips, Mason & Rowe

[57] ABSTRACT

The problem of providing a lightweight, efficient and compact impingement plate type heat exchanger for exchanging heat between at least two fluids is solved by providing a stack of generally parallel plates (36) which include end plates (38, 48), intermediate impingement orifice plates (98, 99) and intermediate manifold plates (96). Inlets (40, 54) and outlets (50, 42) for the two fluids are provided in the end plates. The impingement orifice plates have orifice areas (110) defining two tortious flow paths (68, 86) generally parallel to each other and generally perpendicularly through the plates for the two fluids. The manifold plates and portions of the impingement orifice plates have slots (102, 106) and openings (112, 114, 118) for distributing the two fluids parallel and perpendicularly through the stack of plates to their respective tortious flow paths. Therefore, all extraneous headers, manifolds and housing components are completely obviated.

21 Claims, 4 Drawing Sheets

42
66
28
27 (58)
38
66
40
36
106
108
106
102
96
102
102
104
110
102
110
96
104
64
114
68
98
112
110
120
114
116
118
99
122
60
62
100
16
68
64
74
122
110
76
99
114
106
106
112
98
108
114
102
102
68
104
96
54
102
68
72
72
48
28
76
70
50
72
2

IMPINGEMENT PLATE TYPE HEAT EXCHANGER

FIELD OF THE INVENTION

This invention generally relates to the art of heat exchangers and, particularly, to a heat exchanger of the impingement plate type.

BACKGROUND OF THE INVENTION

Heat exchangers using an impingement cooling principle are known for exchanging heat between different fluids flowing through the exchanger. Some heat exchangers that use the impingement cooling principle are of the impingement plate type. With such heat exchangers, fluid passes through a plurality of holes in a given plate and strikes a solid portion or "impinges" against a subsequent, usually parallel, plate where it moves along the plate to the nearest hole or orifice and passes through the subsequent plate for impingement against a solid portion of the next plate. Eventually, after passing through a series of plates, the fluid leaves the heat exchanger. This impingement cooling principle aids in the heat transfer between the fluid and each plate. Of course, the orifices in adjacent plates are misaligned intentionally so that the fluid must impinge a subsequent plate prior to passing through the orifices thereof. This forces the fluid to impinge against each plate after passing through the previous plate to provide a tortious path for the fluid rather than permitting the fluid merely to flow through holes in a stack of plates.

In my U.S. Pat. No. 4,494,171 to Bland and Niggemann, dated January 15, 1985 and assigned to the assignee of this invention, an impingement cooling apparatus is shown for use in the removal of heat from a heat liberating device. As exemplified in that patent, the impingement cooling principle is carried out by a stack of orifice plates. As with most all prior art, the stack of plates is fitted within a housing. In other words, most prior art utilize a stack of impingement orifice plates to define a core providing an impinging tortious path for one or more fluids. Usually, a manifold or header is provided at one or both ends of the stack of orifice plates or in the housing to provide some sort of "plumbing" to distribute the incoming and outgoing fluid(s) to the interior impingement orifice plates There is a definite need, particularly in aircraft or aerospace fields, to provide more compact, more efficient and lighter weight components because these parameters are of such critical importance in those fields The problem with many cooling or heat exchanger apparatus which use the impingement principle is that the housing and/or manifolds take up as much or more space than the impingement plates themselves, and the housing and/ or manifold often weighs more than the stack of impingement orifice plates.

This invention is directed toward solving those problems by providing an impingement plate type heat exchanger wherein the stack of plates itself includes the inlets and outlets for the fluids as well as the manifold flow paths for the fluids to be distributed to the tortious flow paths through the impingement orifice plates. Therefore, no extraneous housing means, manifold means or other plumbing components are required.

SUMMARY OF THE INVENTION

An object, therefore, is to provide a new and improved impingement plate type heat exchanger for exchanging heat between at least two fluids.

In the exemplary embodiment of the invention, the heat exchanger is formed totally by a stack of generally parallel plates. At least one plate at each opposite end of the stack is a solid plate but defines the inlets and outlets for the two fluids In the preferred embodiment, the inlet for the first fluid and the outlet for the second fluid are formed in one end plate at one end of the stack, and the outlet for the first fluid and the inlet for the second fluid are formed in the end plate at the opposite end of the stack.

The intermediate plates, i.e. the plates between the substantially solid end plates, form impingement orifice plates and manifold plates. In the preferred embodiment, some of the plates immediately inside the end plates have slots communicating with the inlets and define flow passages extending generally transversely of the stack of plates. Other intermediate plates form the impingement orifice plates defining first and second tortious flow paths generally parallel to each other and generally perpendicularly to the plates for the first and second fluids, respectively The transverse slots in the manifold plates distribute the fluids from their respective inlets to the tortious flow paths.

In the preferred embodiment, the tortious flow paths defined by the impingement orifice plates are located generally centrally of the stack of plates. Some of the impingement orifice plates also form manifold plates with aligned openings defining flow passages generally parallel to and outside the centrally located tortious flow paths to distribute the fluids lengthwise of the stack.

Although a specific flow pattern for the heat exchanger fluids is shown in the detailed description, a variety of flow patterns can be designed within the concepts of the invention of providing a heat exchanger which is formed totally by a stack of plates requiring no exterior housing, separate manifolds or any other extraneous structural components or plumbing to distribute incoming and outgoing fluids between the tortious flow paths defined by the impingement orifice plates.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
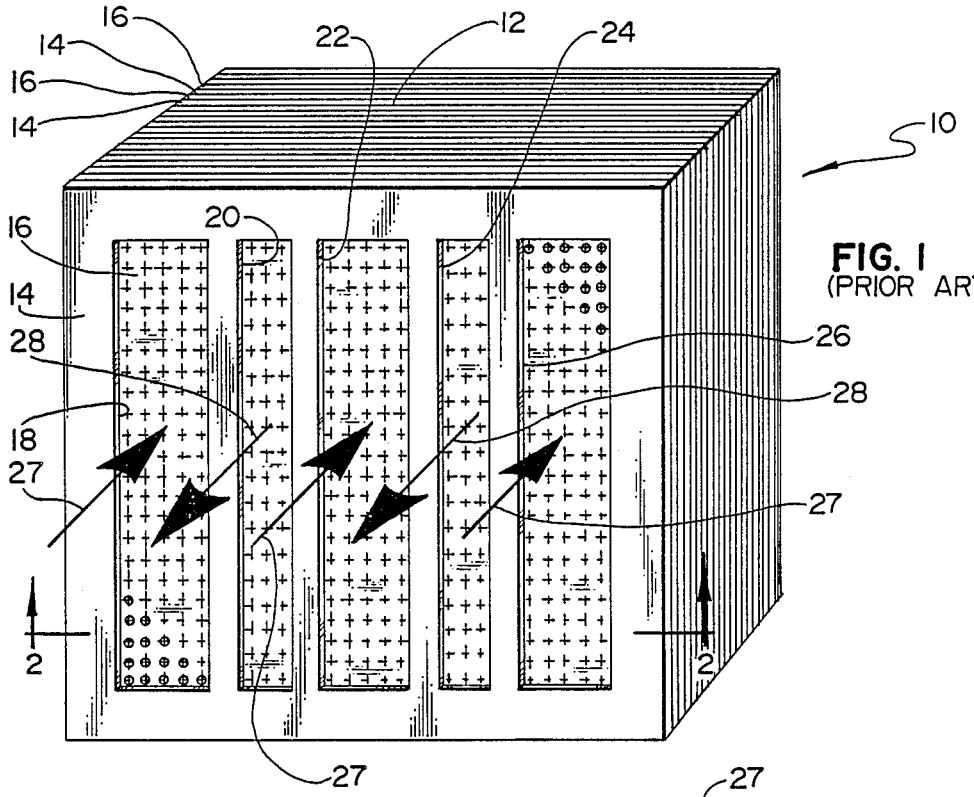
FIG. 1 (PRIOR ART)
FIG. 1 is a perspective view of a conventional core for an impingement plate type heat exchanger.

Referring to the drawings in greater detail, and first to FIG. 1, a conventional core structure, generally designated 10, is shown to comprise a stack of plates 12 which may comprise partition plates 14 and impingement orifice plates 16 which alternate through the stack of plates. In essence, the partition plates define flow paths 18–26 extending generally parallel to each other and generally perpendicularly through the plates. For instance, flow paths 18, 22 and 26 may be provided for a first fluid as indicated by the directional arrows 27 whereby the first fluid flows through the stack of plates in one direction. Flow paths 20 and 24 define passages for the second fluid flowing in the opposite direction through the stack, as indicated by directional arrows 28. In other words, the flow paths through the stack of plates for the two fluids are in opposite directions.

Figure 2:
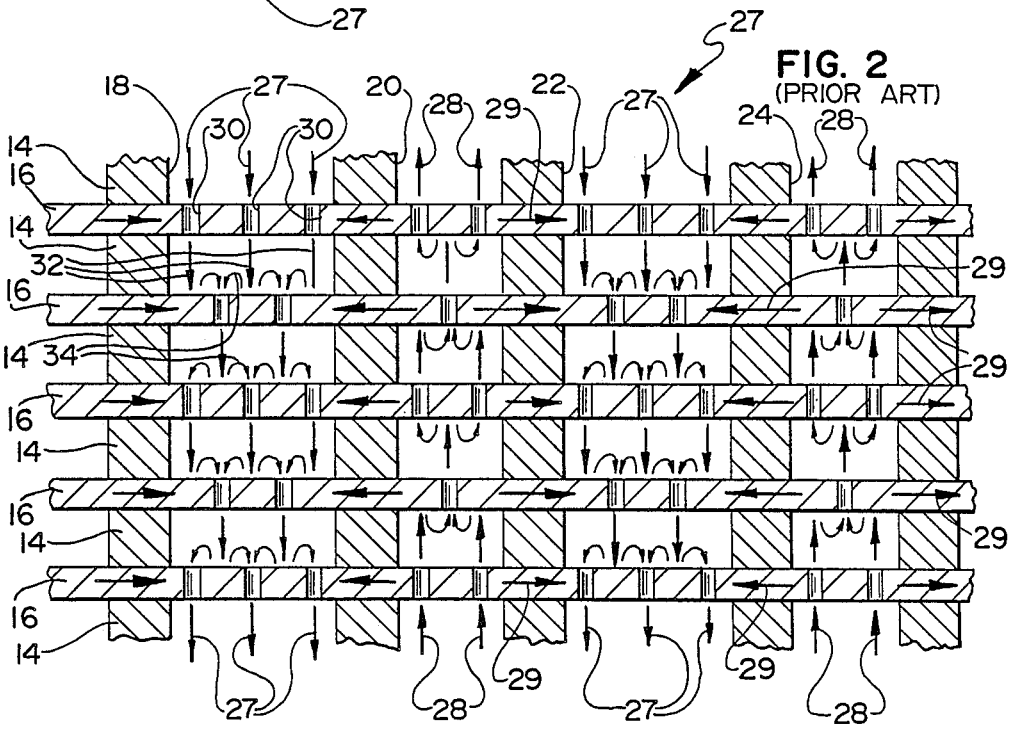
FIG. 2 (PRIOR ART)
FIG. 2 is a fragmented horizontal section, on an enlarged scale, taken generally in the direction of line 2—2 of FIG. 1.

Referring to FIG. 2, a plurality of arrows 27 for the first fluid and 28 for the second fluid are shown flowing through flow paths 18–24, corresponding to the illustration of FIG. 1. This view is an enlargement of only a portion of the stack of plates shown in FIG. 1. It can be seen that partition plates 14 and impingement orifice plates 12 alternate in an abutting relationship to define through walls providing the flow paths 18–24. These walls themselves transfer heat between the flow paths. In addition, heat is transferred between the flow paths through the medium of the impingement orifice plates, as indicated by arrows 29. The depiction of a plurality of flow paths for each of the two fluids simply represents that the two fluids may not simply flow through the heat exchanger in a single pass but may sinusoidally go back and forth through the heat exchanger for cooling purposes.

Referring to just the left side of FIG. 2, i.e. flow path 18, it can be seen that the first fluid defined by arrows 27 pass through orifices 30 in the first impingement orifice plate 16, in the direction of arrows 32. After passing through orifices 30, the fluid impinges upon solid portions of the next impingement orifice plate 16, as represented by arrows 34. After the fluid strikes or "impinges" against the solid portions of that orifice plate, the fluid moves along the plate to the adjacent orifices and flows through that plate for impingement upon the subsequent impingement orifice plate 16. Once again, the impinging fluid moves along the subsequent plate and passes through the orifices therein and so on through the stack of plates. The orifices in adjacent impingement orifice plates 16 are misaligned intentionally so that the fluid must impinge against a subsequent plate prior to passing through the orifices in that plate, and so on through the stack of plates.

The same tortious path is defined by the impingement orifice plates for the second fluid as indicated by arrows 28 in FIG. 2. Without going into further details, it can be seen from all of the arrows in the depiction that the impingement orifice plates 16 also define tortious flow paths for the second fluid represented by arrows 28 as the second fluid flows through and impinges against alternating impingement orifice plates through the stack.

The structure and operation of a stack of plates as described above in relation to FIGS. 1 and 2, to provide an impingement plate type heat exchanging means, is generally conventional and used in the art as the core or interior structure of a more elaborate heat exchanger unit. Specifically, such a core usually is mounted within a surrounding housing. A header usually is mounted to the housing and/or the stack of plates at opposite ends of the stack, with a singular inlet and outlet for each of the respective fluids. The headers or still additional structures provide manifolding for distributing the fluids from their respective inlets to the plurality of flow paths through the stack of plates, and then from the plurality of flow paths to the respective singular outlets for the fluids. The invention herein contemplates eliminating all of such extraneous housings, headers and manifolding structures by providing a completely self-contained heat exchanger solely from a stack of plates.

Figure 3:
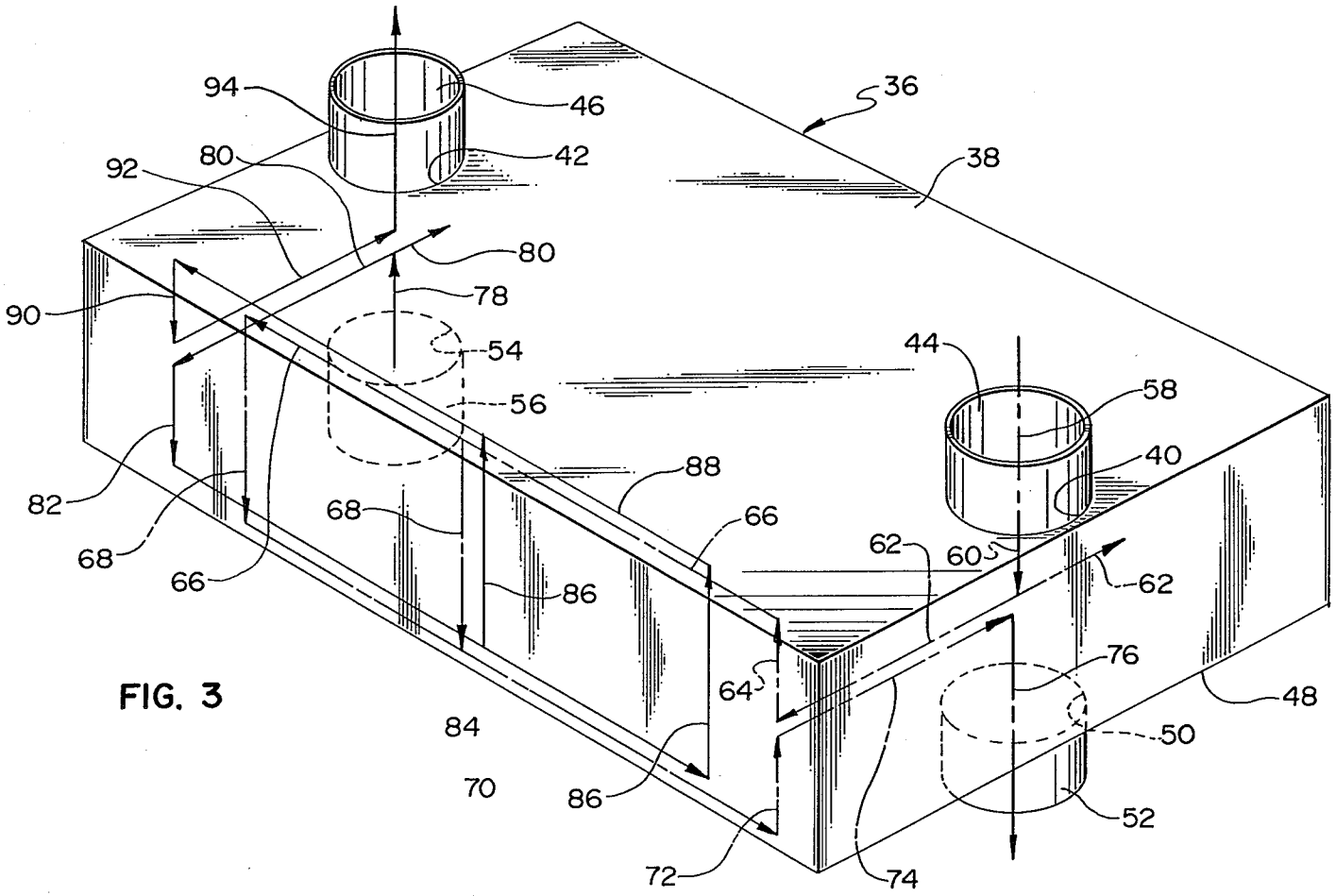
FIG. 3 is a perspective view of an impingement plate type heat exchanger according to the invention, showing somewhat schematically the flow circuits through the exchanger for two fluids.

More particularly, FIG. 3 shows a somewhat schematic illustration of a stack of plates, generally designated 36, with one plate 38 at one end of the stack having a hole 40 defining an inlet for a first fluid and a hole 42 defining an outlet for a second fluid. Elements 44 and 46 simply represent some form of conduit between inlet 40 and an appropriate source of the first fluid, and between outlet 42 and an appropriate sump or the like for the second fluid. Likewise, an end plate 48 at the opposite end of the stack has a hole 50 and an appropriate conduit 52 defining an outlet for the first fluid and a hole 54 and an appropriate conduit 56 defining an inlet for the second fluid. Although heat exchanger 36 is shown in block form, it should be understood, and as will be apparent from FIGS. 4 and 5, that this block represents a stack of plates between end plates 38 and 48.

FIG. 3 also shows somewhat schematically a flow circuit for the two fluids. More particularly, the first fluid is shown by a phantom line entering inlet 40, as at 58. The fluid flows perpendicularly through the stack of plates at one end, the right-hand end as viewed in FIG. 3, as at 60. The fluid flows toward a midpoint of the stack and then is distributed laterally, as indicated at 62. It should be understood, for clarity purposes, that the flow circuitry for the fluids are shown only at the front areas of the heat exchanger, but the fluids actually flow in their respective paths throughout substantially the entire area of the stack of plates, again as will be apparent in relation to FIGS. 4 and 5. The fluid then is channeled back upwardly toward the top of the stack, as indicated at 64, and then transversely across the stack, as indicated at 66. The first fluid then is directed downwardly through the entire stack, as indicated at 68. During this portion of its flow, the fluid passes through orifices of a number of interior impingement orifice plates. At the bottom of the stack, as viewed in FIG. 3, the first fluid then is directed transversely again, as at 70, to its original end of the stack, upwardly as at 72, transversely as at 74, and back downwardly as at 76, to leave the heat exchanger through outlet 50 and conduit 52.

Likewise, and still referring to FIG. 3, the second fluid is shown by solid arrowed lines which illustrate that the second fluid follows a similar flow circuit as the first fluid, but in an opposite direction from the bottom to the top of the stacked heat exchanger as viewed in FIG. 3. More particularly, the second fluid enters through conduit 56 and inlet 54, as at 78. The fluid flows through the stack at the left-hand thereof and then transversely across a midpoint of the stack as indicated by arrows 80, and then back downwardly to the bottom of the stack, as at 82. The second fluid then flows transversely across the bottom of the stack, as at 84, and then upwardly through the entire stack, as at 86, through a tortious flow path defined by impinging orifice plate means. The second fluid then flows across the upper portion of the stack, as at 88, toward its originating end of the stack, downwardly as at 90, and inwardly as at 92 for exiting the stack through outlet 42 and conduit 46, as at 94.

Figure 4:
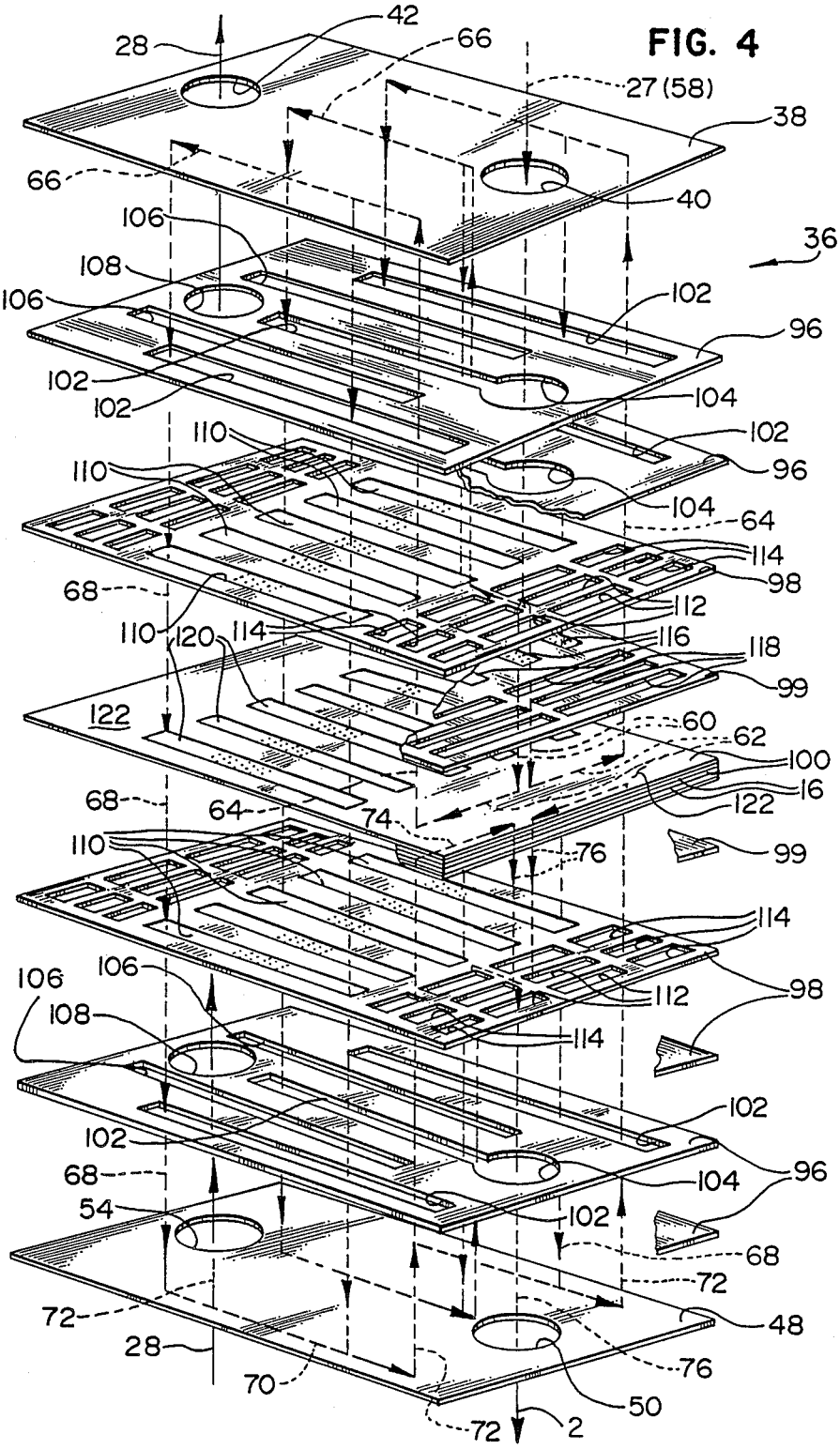
FIG. 4 is an exploded perspective view of various of the plates comprising the heat exchanger of the invention, showing the flow circuit through the plates for a first fluid.
Figure 5:
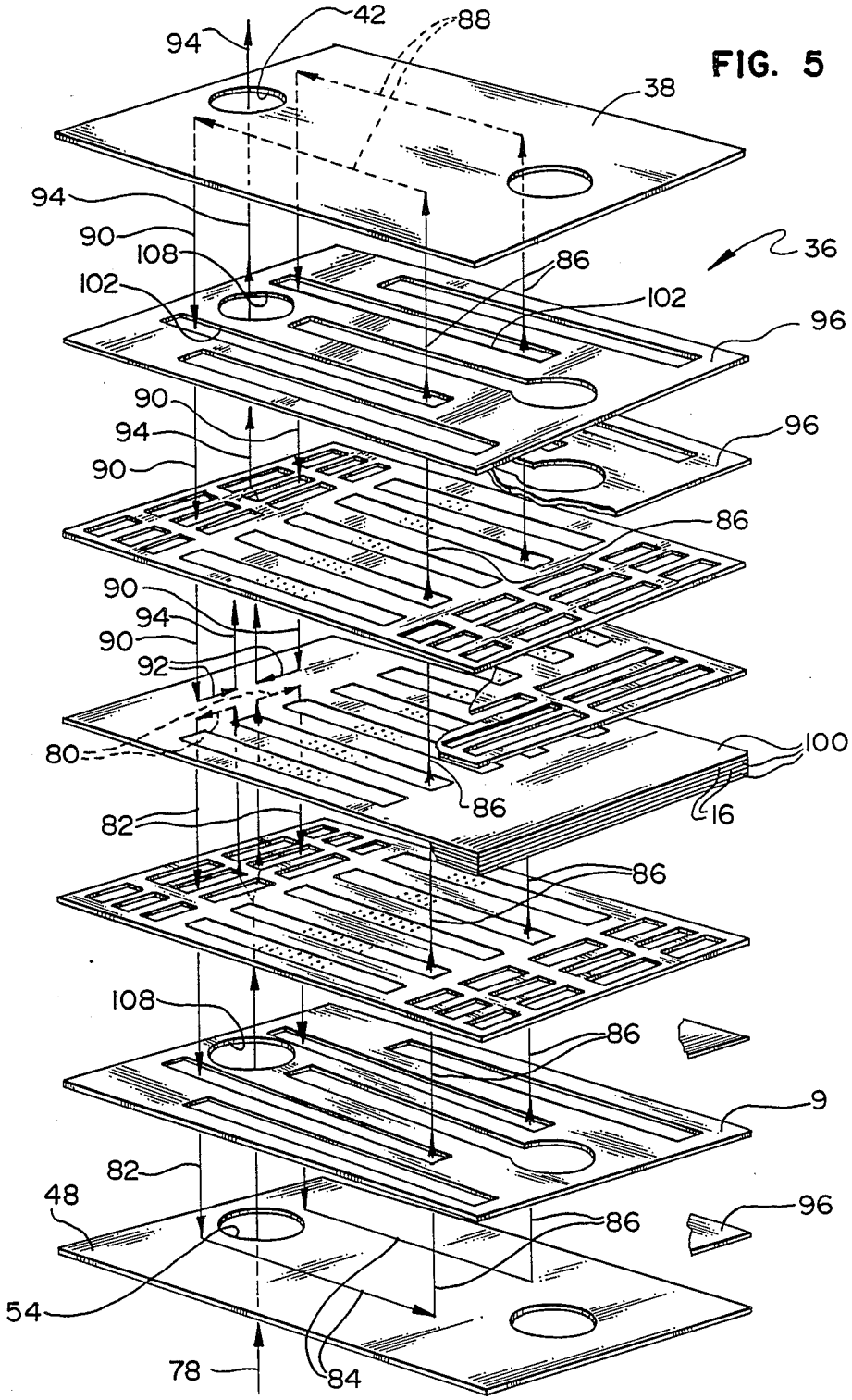
FIG. 5 is a view similar to that of FIG. 4, showing the flow circuit for the second fluid.

The above flow circuits are repeated in FIGS. 4 and 5, respectively, with the various plates of the stack being in exploded illustrations to show the specifics of the flow circuitry. In particular, end plate 38 is shown at the top of the stack with first fluid inlet 40 and second fluid outlet 42. End plate 48 is shown at the bottom of the stack with first fluid outlet 50 and second fluid outlet 54, as described in relation to FIG. 3. It should be understood that, as with all of the plates described hereinafter, there may be more than one plate 38 or more than one end plate 48 in stacked relationship to define more depth for the inlets and outlets. The number of end plates, as well as the impingement orifice plates and manifold plates described hereinafter, can vary in specific numbers.

Stacked between end plates 38 and 48 are a plurality of manifold plates 96, impingement orifice plates 98 and 99 and center or divider plates 100.

In order to understand the purpose of manifold plates 96, brief reference should be made to FIG. 1 which illustrates a conventional impingement plate core having three flow paths 27 for a first fluid and two opposite flow paths for a second fluid. To that end, referring to Figure 4 which shows the flow circuitry for the first fluid, it can be seen that manifold plates 96 have three slots 102 (the center slot 102 being keyhole shaped to include an enlarged opening 104) extending further to the right of the stack than two alternating slots 106 which extend further to the left of the stack. These slots represent three flow paths for the first fluid entering at 27 and two slots 106 for the second fluid exiting at 28. Enlarged opening 104 of the center slot 102 is vertically aligned with inlet 40 and outlet 50 for the first fluid. In addition, openings 108 are formed in manifold plates 96 in alignment with both inlet 54 and outlet 42 for the second fluid, as at 28.

The next series of plates, and concentrating on the right-hand areas of FIG. 4, are the impingement orifice plates 98. It can be seen that these plates have generally parallel slots 110 in transverse alignment with slots 102 and 106 in manifold plates 96. It is important to understand that although "slots" 110 are shown in the drawings, these "slots" actually are areas of orifices which are in alignment with actual slots 102,106 in manifold plates 96. They are shown in the drawings as rectangular slots simply to facilitate the illustration. Impingement orifice plates 98 also have a series of center or inner openings 112 elongated in the direction of the adjacent side edges of the plates, and a series of elongated outer openings 114 near the corners of the plates. The purposes of these openings will be described hereinafter, but it should be noted that the inner ends of inner openings 112 are in alignment with enlarged openings 104 in manifold plates 96. The next impingement orifice plates 99 likewise have five elongated areas of orifices 116 in alignment with orifice areas 110 in plates 98 and slots 102 in manifold plates 96. Orifice plates 99 also serve as manifold plates and include a series of elongated openings 118 radiating outwardly in both directions from a projected area defined by openings 104 in manifold plates 96. However, it can be seen that elongated openings 118 in orifice plates 98 span both the series of openings 112 and 114 in orifice plates 98 on both sides of openings 104 in manifold plates 96.

The center of the stack of plates is defined by orifice plates 100 which, again, have five elongated orifice areas 120 in alignment with orifice areas 116 in orifice plates 99, orifice areas 110 in orifice plates 98 and slots 102 in manifold plates 96. Therefore, it can be seen that an impingement plate type heat exchanging area similar to the configuration shown in FIG. 2 extends entirely through the stack of plates between end plates 38 and 48. Center or divider plates 112 are solid at opposite ends or edges, as at 122. These solid areas are in alignment with openings 118 in orifice plate 99, openings 112 and 114 in orifice plates 98 and slots 102 and 106 and holes 104 and 108 in manifold plates 96. This provides for the reversal of flow described in relation to the flow circuits of FIG. 3 and repeated hereinafter. In addition, FIGS. 4 and 5 show a considerable stack of center or divider plates 100. This is the only place that such a depiction is illustrated in these Figures in order to simplify the drawings. However, as explained with the general operation of such an impingement plate type exchanger structure in relation to FIG. 2, spacer plates 14 are provided alternatingly through the entire stack of impingement orifice plates 98,99 and 100 to carry out the impingement principles described above.

The circuit flow path for the first fluid (27, FIG. 1) is shown by the phantom arrowed lines in FIG. 4 corresponding to the schematic phantom arrowed lines shown in FIG. 3. Likewise, the flow circuit for the second fluid is shown by full arrowed lines in FIG. 5 corresponding to the full lines shown schematically and partially in FIG. 3. Therefore, corresponding reference numerals will be used, at least in part, in FIGS. 4 and 5 corresponding to those used in the general description in the circuitry of FIG. 3.

More particularly, referring to FIG. 4 in conjunction with FIG. 3, the first fluid enters the self-contained heat exchanger through inlet 40 in upper end plate 38 as at 58. The fluid then flows through enlarged openings 104 in manifold plates 96, with some of the fluid being directed transversely through the center-most slots 102 which are in communication with openings 104. The fluid then enters slots 112 in orifice plates 98 where the fluid is spread outwardly beyond the limits of openings 104 in manifold plates 96. This fluid then enters the inner areas of slots 118 in orifice plates 99 which spread the fluid further along the side areas of the stack of plates. Note the directional arrows 60 and 62 corresponding to the similar directional arrows in FIG. 3. The fluid can go no further through the stack of plates because of the solid area 122 of center or divider plates 100. At this point, the fluid is reversed back through the outer areas of slots 118 in orifice plates 99 and upwardly through slots 114 in orifice plates 98, noting the directional arrows 64 corresponding to FIG. 3. Since slots 118 in orifice plates 99 overlap both series of slots 112 and 114 in orifice plates 98, it can be understood that distinct downward and then upward flow paths are defined in a reversing direction. The fluid then flows from openings 114 in orifice plates 98 into the two outermost slots 102 in manifold plates 96. Since the fluid cannot go further through end plate(s) 38, the fluid is directed transversely inwardly by slots 102 toward the center of the stack of the plates, noting the directional arrows 66 corresponding to FIG. 3.

The second fluid then is directed downwardly through slots 102 in manifold plates 96, impingement orifice areas 110 in orifice plates 98, impingement orifice areas 120 in center or divider plates 100, and through the corresponding orifice plates 99, orifice plates 98 and manifold plates 96 on the other end (or underside as viewed in the drawing) of divider plates 100. Note the directional arrows 68 corresponding to FIG. 3. Although heat exchanging between the two fluids is carried out through the entire stack of plates 36, the impingement plate heat exchanging principle basically is performed as the fluid flows through the impingement orifice areas 110 and 120 through the center of the stack.

Once the fluid reaches the opposite end of the stack, i.e. at the bottom of FIG. 4, the fluid will be stopped by end plate 48 and reversed through the respective outermost and center slots 102 in the lower manifold plates 96, through the series of elongated openings 114 in orifice plates 98, through the outermost areas of elongated openings 118 in orifice plates 99 and back against the underside of the solid area 122 of divider plates 100. Again, note the reversing directional arrows 70 and 72 corresponding to FIG. 3. Divider plates 100, through the overlapping relationship of slots 118 in orifice plates 99, then reverse the second fluid again and direct the fluid through the innermost areas of openings 118 in orifice plates 99, through the inner series of openings 112 in orifice plates 98, through enlarged openings 104 in manifold plates 96, and out of the self-contained heat exchanger through outlet 50 in end plate 48. Again, note the directional arrows 74 and 76 corresponding to FIG. 3.

In view of the detailed description of the flow circuit for the first fluid through the stack of plates 36 in FIG. 4, the flow circuit for the second fluid through the stack of plates, as illustrated in FIG. 5, will be simplified by stating that all of the plates, along with their functions, openings, slots, orifice areas, solid areas and the like perform identical functions as described in relation to FIG. 4. Just a few differences should be noted. First, of course, the second fluid enters bottom end plate 48, through inlet 54, and out through top end plate 38, through outlet 42. Second, as described in relation to flow paths 28 in FIGS. 1 and 2, the second fluid flows through the alternating slots 102 in manifold plates 96. In other words, the second fluid does not flow through the two outside slots 102 nor the center "keyhole" shaped slot 102 through which the first fluid flows. To that end, it can be seen that manifold plates 96 have the circular openings 108 in vertical alignment with inlet 54 and outlet 42 in end plates 48 and 38, respectively, for the second fluid. Otherwise, the multiple reversal of flow, including two reversals on each side of divider plates 100 is the same as that described in detail in relation to the flow circuit for the first fluid in FIG. 4. The specific directional path of the second fluid is shown by the arrowed directional lines in FIG. 5 corresponding to the description and reference numerals in FIG. 3.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An impingement plate type heat exchanger for exchanging heat between at least first and second fluids, comprising:

a stack of generally parallel plates wherein:

at least one plate at an end of the stack defines a first inlet for the first fluid;

at least one plate at an end of the stack defines a first outlet for the first fluid;

at least one plate at an end of the stack defines a second inlet for the second fluid;

at least one plate at an end of the stack defines a second outlet for the second fluid;

a plurality of plates between opposite ends of the stack form impingement orifice plates defining first and second tortious flow paths generally parallel to each other and generally perpendicularly through the plates for the first and second fluids, respectively; and a plurality of plates between opposite ends of the stack form manifold plates defining flow paths for distributing the first fluid from the first inlet through the first tortious flow path to the first outlet and distributing the second fluid from the second inlet through the second tortious flow path to the second outlet.

2. The impingement plate type heat exchanger of claim 1 wherein the inlet for the first fluid and the outlet for the second fluid are defined by at least one plate at one end of the stack, and the inlet for the second fluid and the outlet for the first fluid are defined by at least one plate at an opposite end of the stack.

3. The impingement plate type heat exchanger of claim 1 wherein at least one of said manifold plates has a slot defining a flow passage extending generally transverse to said tortious flow paths.

4. The impingement plate type heat exchanger of claim 1 wherein at least some of said manifold plates have aligned openings defining at least one flow passage extending generally parallel to said tortious flow paths.

5. The impingement plate type heat exchanger of claim 4 wherein at least one of said manifold plates has a slot defining a flow passage extending generally transverse to said tortious flow paths.

6. The impingement plate type heat exchanger of claim 4 wherein said aligned openings and defined flow passage are located to one side of the stack of plates.

7. The impingement plate type heat exchanger of claim 1 wherein said tortious flow paths defined by the impingement orifice plates are located generally centrally of the stack of plates.

8. The impingement plate type heat exchanger of claim 7 wherein at least some of said manifold plates have aligned openings defining at least one flow passage generally parallel to and outside the tortious flow paths.

9. The impingement plate type heat exchanger of claim 1, including a plurality of said tortious flow paths for at least one of the first and second fluids, and wherein at least one of the manifold plates has slot means defining a flow passage for distributing the one fluid transversely to its plurality of flow paths.

10. An impingement plate type heat exchanger for exchanging heat between at least first and second fluids, comprising:

a stack of generally parallel plates wherein:

at least one plate at one end of the stack defines an inlet for the first fluid and an outlet for the second fluid;

at least one plate at an opposite end of the stack defines an inlet for the second fluid and an outlet for the first fluid;

a plurality of plates between opposite ends of the stack form impingement orifice plates defining first and second tortious flow paths generally parallel to each other and generally perpendicularly through the plates for the first and second fluids, respectively; and a plurality of plates between opposite ends of the stack form manifold plates defining flow paths for distributing the first fluid from the first inlet through the first tortious flow path to the first outlet and distributing the second fluid from the second inlet through the second tortious flow path to the second outlet, at least one of the manifold plates having a slot defining a flow passage extending generally transverse to the tortious flow paths.

11. The impingement plate type heat exchanger of claim 10 wherein at least some of said manifold plates have aligned openings defining at least one flow passage extending generally parallel to said tortious flow paths.

12. The impingement plate type heat exchanger of claim 11 wherein said aligned openings and defined flow passage are located to one side of the stack of plates.

13. The impingement plate type heat exchanger of claim 10 wherein said tortious flow paths defined by the impingement orifice plates are located generally centrally of the stack of plates.

14. The impingement plate type heat exchanger of claim 13 wherein at least some of said manifold plates have aligned openings defining at least one flow passage generally parallel to and outside the tortious flow paths.

15. The impingement plate type heat exchanger of claim 10, including a plurality of said tortious flow paths for at least one of the first and second fluids, and wherein at least one of the manifold plates has slot means defining a flow passage for distributing the one fluid transversely to its plurality of flow paths.

16. An impingement plate type heat exchanger for exchanging heat between at least first and second fluids, comprising:

a stack of generally parallel plates wherein:

at least one plate at one end of the stack defines an inlet for the first fluid and an outlet for the second fluid;

at least one plate at an opposite end of the stack defines an inlet for the second fluid and an outlet for the first fluid;

a plurality of plates between opposite end of the stack form impingement orifice plates defining first and second tortious flow paths generally parallel to each other and generally perpendicularly through the plates for the first and second fluids, respectively, the tortious flow paths being defined by impingement orifice areas located generally centrally of the stack of plates; and a plurality of plates between opposite ends of the stack form manifold plates defining flow paths for distributing the first fluid from the first inlet through the first tortious flow path to the first outlet and distributing the second fluid from the second inlet through the second tortious flow path to the second outlet.

17. The impingement plate type heat exchanger of claim 16 wherein at least some of said manifold plates have aligned openings defining at least one flow passage generally parallel to and outside the tortious flow paths.

18. The impingement plate type heat exchanger of claim 16, including a plurality of said tortious flow paths for at least one of the first and second fluids, and wherein at least one of the manifold plates has slot means defining a flow passage for distributing the one fluid transversely to its plurality of flow paths.

19. An impingement plate type heat exchanger for exchanging heat between at least first and second fluids, comprising:

a stack of generally parallel plates which form a completely self-contained unit including end plates, intermediate manifold plates and intermediate impingement orifice plates, the end plates including inlets and outlets for the first and second fluids, the impingement orifice plates having impingement orifice areas, and at least the manifold plates having openings to facilitate distributing the fluids to their respective orifice areas in the impingement orifice plates.

20. The impingement plate type heat exchanger of claim 19 wherein said impingement orifice plates also have openings in communication with the openings in the manifold plates.

21. The impingement plate type heat exchanger of claim 20 wherein said orifice areas of the impingement orifice plates are located generally centrally of the stack of plates, and the openings in the impingement orifice plates are located at least to one side of the centrally located orifice areas.

* * * * *